United States Patent [19]

Phillips et al.

[11] Patent Number: 4,979,291

[45] Date of Patent: Dec. 25, 1990

[54] APPARATUS AND METHOD OF TERMINATING A WIRE TO A TWO PART INSULATED TERMINAL

[75] Inventors: Howard C. Phillips; David J. Erb, both of Harrisburg, Pa.

[73] Assignee: AMP Incorporated, Harrisburg, Pa.

[21] Appl. No.: 500,644

[22] Filed: Mar. 28, 1990

[51] Int. Cl.[5] ..... H01R 43/04

[52] U.S. Cl. ..... 29/863; 29/753

[58] Field of Search ..... 29/863, 753, 857, 861, 29/862, 864, 865, 866, 867, 748, 751

[56] References Cited

U.S. PATENT DOCUMENTS

| | | | |
|---|---|---|---|
| 3,289,284 | 12/1966 | Zent | 29/753 |
| 3,609,860 | 10/1971 | Hills | 29/753 |
| 4,214,361 | 7/1980 | Coldren et al. | 29/863 |
| 4,272,879 | 6/1981 | Wigby et al. | 29/863 |
| 4,426,772 | 1/1984 | Collier et al. | 29/863 |
| 4,557,048 | 12/1985 | Cordeiro | 29/863 |

*Primary Examiner*—P. W. Echols
*Assistant Examiner*—David P. Bryant
*Attorney, Agent, or Firm*—James M. Trygg

[57] ABSTRACT

An apparatus and method are disclosed for terminating a wire to a terminal having a metal contact that is partially assembled to an insulated housing. The apparatus includes a stop that abuttingly engages bulges in the contact after crimping and thereby prevents axial movement of the contact while sliding the insulated housing thereover. Both the crimping and assembly operations are performed in a single workstation.

14 Claims, 6 Drawing Sheets

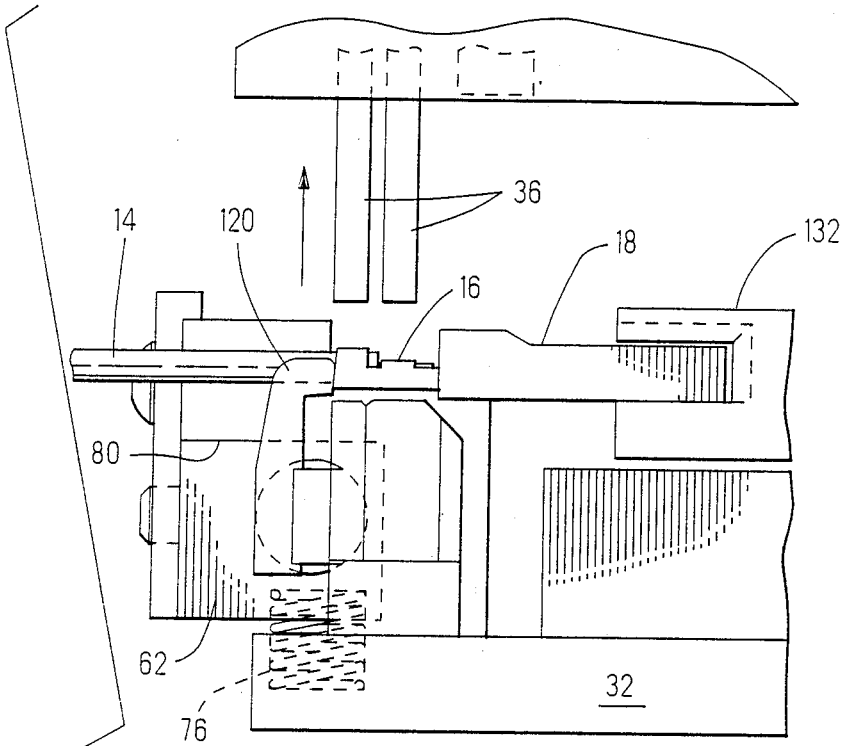
FIG. 8
FIG. 9
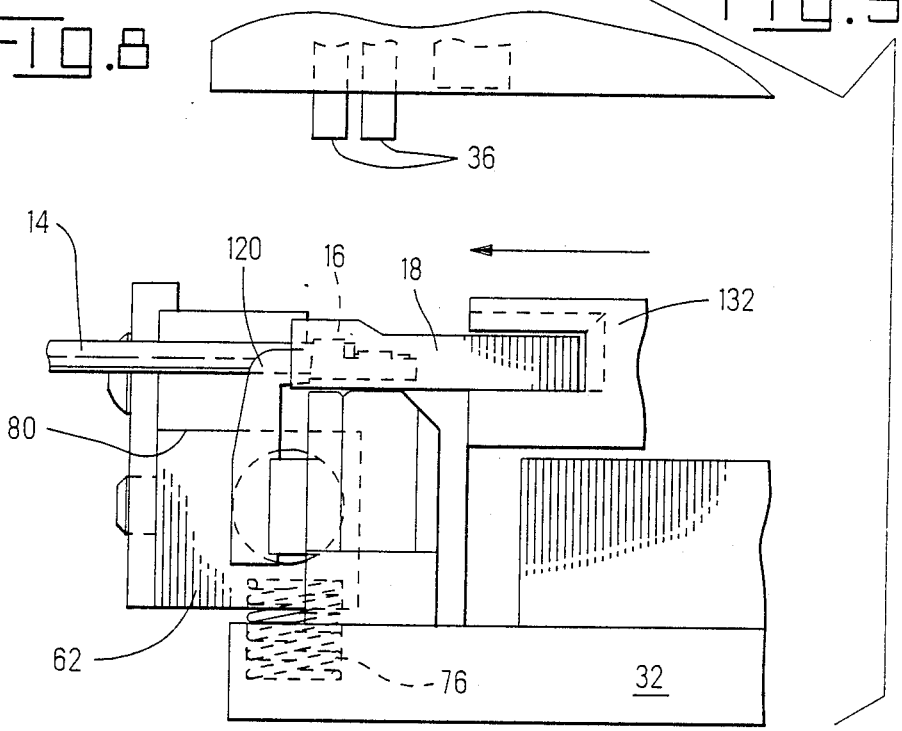

APPARATUS AND METHOD OF TERMINATING A WIRE TO A TWO PART INSULATED TERMINAL

The present invention relates to an apparatus for applying an electrical terminal and insulated housing to an end of a wire.

BACKGROUND OF THE INVENTION

Apparatus for applying electrical terminals of the type having an insulated housing partially assembled thereto, typically require two workstations, one to crimp the terminal onto the wire and another to push the insulated housing over the crimped terminal. This, of course, requires that the wire be presented to each workstation in turn. Another apparatus, which is described in U.S. Pat. No. 4,557,048, which issued Dec. 10, 1985 to Cordeiro, performs both the crimping and pushing functions in a single workstation. The wire is securely clamped so that after the terminal is crimped onto the conductor, the upper crimp tooling can be withdrawn and the wire and terminal raised by the wire clamp, thereby leaving sufficient space around the crimped terminal to slide the insulated housing thereover. Such an apparatus, of necessity, is somewhat complex and is costly to manufacture and maintain. The present invention, on the other hand, does not require a moveable wire clamp to provide space to slide the insulated housing over the crimped terminal.

SUMMARY OF INVENTION

A method and apparatus are provided for attaching an electrical terminal to the end of a wire, the terminal including a contact and an insulating housing. The terminal is positioned in a workstation having a stop so that an end of the contact is adjacent the stop. A wire to receive the electrical terminal is positioned in the workstation. The apparatus is then caused to crimp the contact to the end of the wire and then move the housing in a direction toward the stop so that the end of the contact abuts the stop and the housing moves into assembled engagement with the contact. The apparatus includes a stop means, means for positioning the terminal within the workstation, means for receiving a wire to be assembled to the terminal, means for terminating the contact to the end of the wire, and means for moving the housing toward the stop means and into assembled engagement with the contact.

DESCRIPTION OF THE DRAWINGS

FIGS. 8, 9 and 10 are views similar to that of FIG. 4 showing various stages of operation of the applicator.

DESCRIPTION OF THE PREFERRED EMBODIMENT

Figure 1:
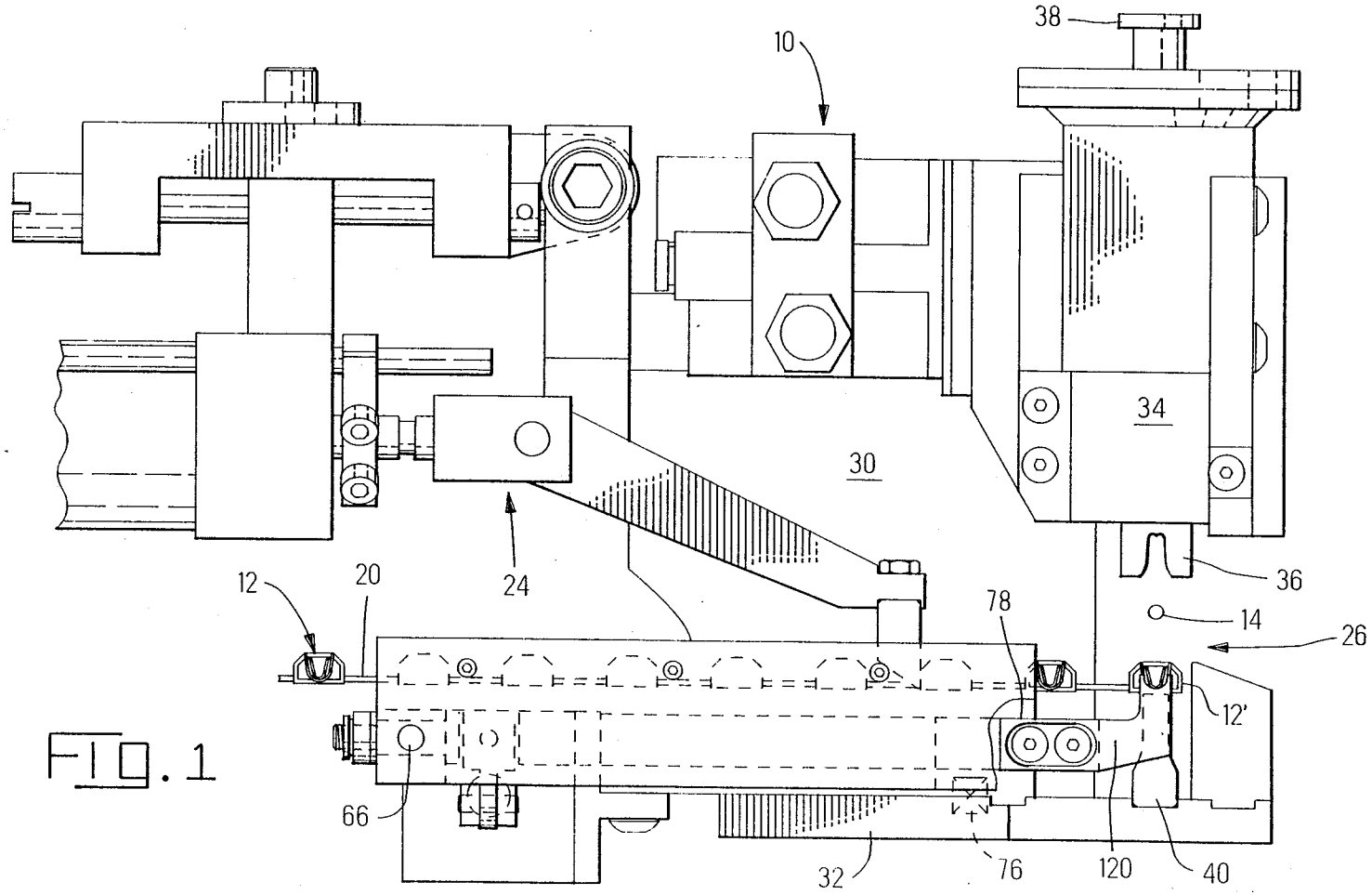
FIG. 1 is a front view of an electrical terminal applicator showing the teachings of the present invention.
Figure 2:
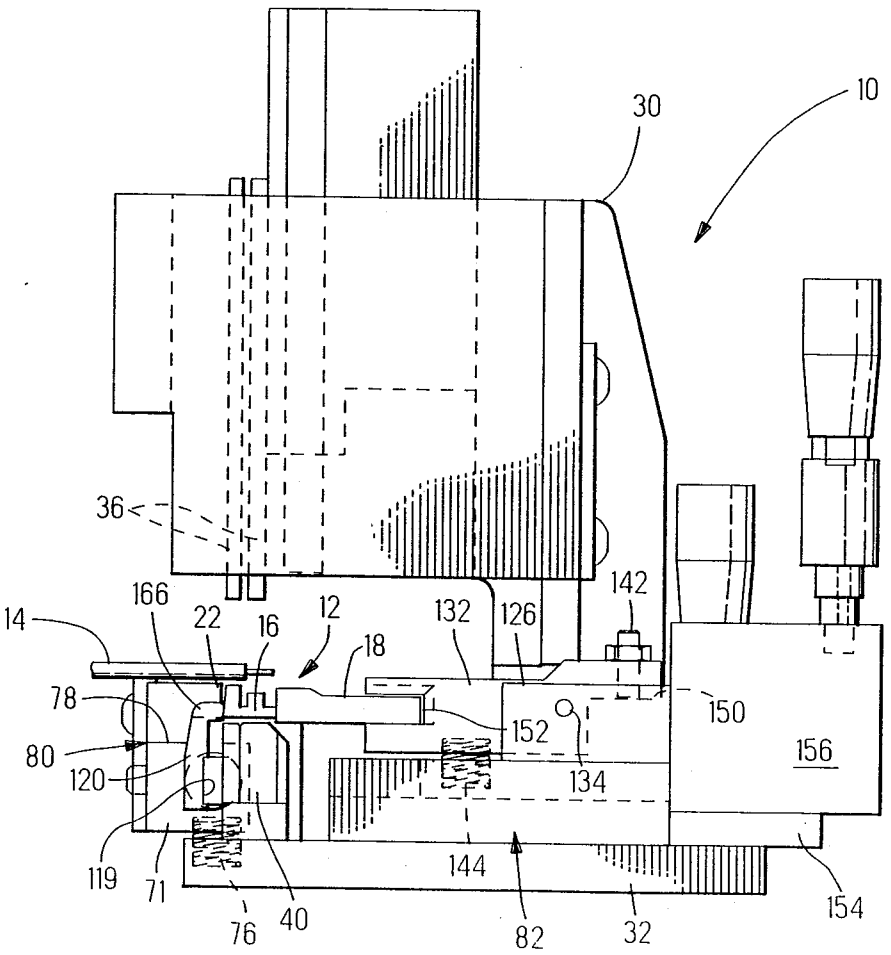
FIG. 2 is a right end view of the applicator shown in FIG. 1.

There is shown in FIGS. 1 and 2 an applicator 10 for applying terminals 12 to the end of a wire 14. The terminal 12 is of the type having a contact 16 that is crimped to the wire 14 and an insulating housing 18 which is partially assembled to the contact as shown. The terminals 12 are supplied on a reel, not shown, wherein each terminal 12 is interconnected by a carrier strip 20 in the usual manner. The carrier strip 20 and associated terminals 12 are fed along a guide 22 by means of a feed mechanism 24 to a workstation 26. The applicator 10 includes a frame 30 and a base 32 rigidly attached together. The frame 30 is arranged to support the feed mechanism 24 and a ram 34 which carries a crimping tool 36 and is positioned directly above the workstation 26, as seen in FIGS. 1 and 2. The ram 34 includes the usual coupling 38 for operationally engaging a press, not shown, so that the ram 34 may be made to undergo reciprocating motion toward and away from the workstation 26. An anvil 40 is positioned on the base 32 directly under and in alignment with the crimping tool 36 so that as the tool 36 reciprocates, it moves into and out of crimping engagement with the anvil 40. The feed mechanism 24 is arranged to move the carrier strip 20 to the right, as viewed in FIG. 1, to position a single terminal 12' in the workstation directly on the anvil 40.

Figure 3:
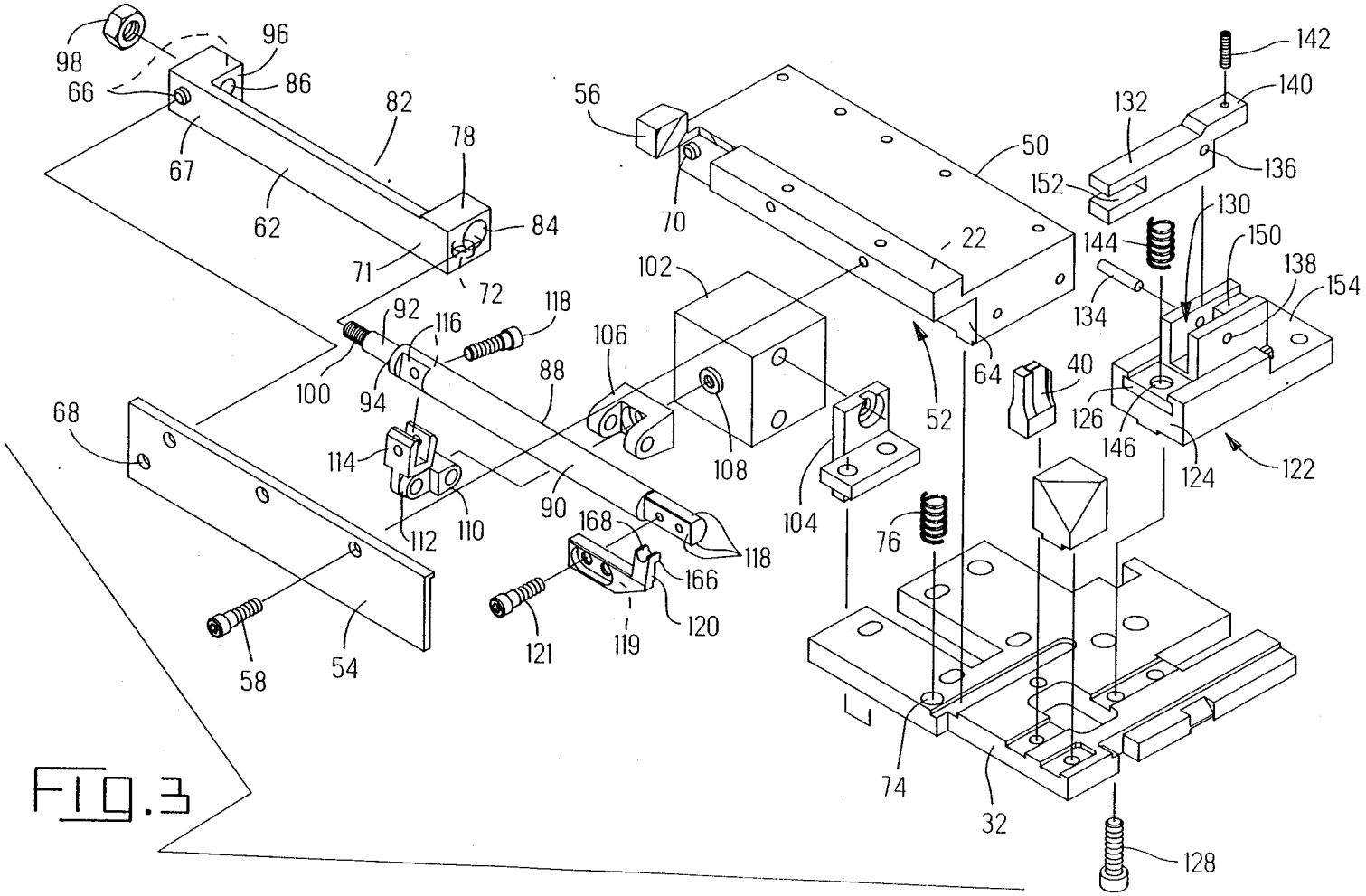
FIG. 3 is an exploded parts view of a portion of the applicator shown in FIG. 1.

As best seen in FIG. 3, the guide 22 is formed in a plate 50 which is attached to the base 32. The plate 50 includes a rabbet cutout 52 which runs for the length of the plate 50 directly under the guide 22. A cover 54 is attached to the surface 56 of the plate 50 by means of the screw fasteners 58 thereby substantially enclosing the cutout 52 to form a cavity 60. An elongated bar 62 having a substantially rectangular cross section is disposed within the cavity 60 and is sized to have substantially no clearance between the cover 54 and the surface 64 of the plate 50 so that there is no appreciable lateral movement of the bar 62. In the vertical direction, however, the bar 62 is slightly smaller than the height of the cavity 60. The bar 62 includes a pair of pins 66 in the end 67 which pivotally engage a hole 68 in the cover 54 and a correspondingly aligned hole 70 in the plate 50. This permits pivotal motion of the bar 62 in the vertical direction within the cavity 60. The other end 71 of the bar 62 includes a downwardly facing blind hole 72 which is in vertical alignment with a corresponding blind hole 74 in the base 32. A compression spring 76 is disposed within the holes 72 and 74, the end 71 being urged upwardly within the cavity 60 until the top surface 78 abuts the top of the cavity 60 as shown at 80 in FIG. 2. The bar 62 includes a clearance cutout 82 that results in a somewhat U-shaped structure, the end 71 being one of the legs of the U and the and 67 being the other leg, as shown in FIG. 3. A pair of holes 84 and 86 are bored through the ends 71 and 67 respectively in the longitudinal direction of the bar 62 and are in mutual alignment.

A pivotal shaft 88 having a major diameter 90 sized for a slip fit to the hole 84 and a minor diameter 92 sized for a slip fit to the hole 86 is disposed therein as shown in FIGS. 1 and 2. A shoulder 94 abuts the surface 96 of the end 67 and a nut 98 is threaded onto an end 100 of the shaft 88 to hold the shaft within the bar 62 and limit axial play while permitting pivotal movement of the shaft 88 with respect to the bar 62. An air cylinder 102, or other similar linear actuator, rigidly attached to the base 32 by means of a bracket 104, is arranged to impart pivotal motion to the shaft 90 through a clevis and toggle arrangement. A clevis 106, attached to the end of a piston rod 108 of the air cylinder 102, is pivotally pinned to one end 110 of a toggle 112, while the other end 114 of the toggle is bifurcated to engage a pair of flats 116 formed in the major diameter 90 of the shaft 88. The end 114 is fastened to the shaft 88 by means of the screw fastener 118. The cutout 82 provides sufficient clearance so that the air cylinder 102 may extend and retract the piston 108 thereby causing the toggle link 112 to pivot the shaft 88 within the holes 84 and 86 of the bar 62. The end of the shaft 88 opposite to the end 100 includes three flat surfaces 118 which are sized to snugly engage a slot 119 formed in a stop 120, as best seen in FIGS. 2 and 3. The stop is secured to the shaft 88 by means of the screw fasteners 121.

A slide assembly 122, as best seen in FIGS. 2 and 3, includes a stationary member 124 and a moveable member 126. The stationary member 124 is fastened to the base 32 by means of the screw fasteners 128 so that the movable member 126 may move toward and away from the anvil 40 and is in alignment therewith. The moveable member 126 includes a nest 130 for receiving a pusher 132 which is pivotally secured within the nest 130 by means of the pin 134 which engages the holes 136 and 138. The widths of the nest 130 and pusher 132 are closely matched so that the pusher 132 may pivot about the pin 134 without appreciable side movement within the nest. The pusher 132 includes an extended portion 140 having a threaded hole containing a set screw 142. A compression spring 144 is disposed within a blind hole 146 in the movable member 126, directly under the pusher 132 and extends upwardly into a blind hole in the pusher, and is arranged to urge the pusher 132 to pivot about the pin 134 in a clockwise direction, as viewed in FIG. 2. This pivotal movement is limited by the set screw 142 engaging a surface 150 disposed in the nest 130 directly under the portion 140 of the pusher. Opposite the portion 140, the pusher 132 includes a channel 152 for receiving an insulated housing 18 of a terminal 12, as best seen in FIG. 2. The set screw 142 is adjusted to align the channel 152 with the anvil 40. The stationary member 124 of the slide assembly 122 includes an extended portion 154 to which a linear actuator 156, an air cylinder in the present example, is secured. The air cylinder 156 has a piston rod, not shown, which operationally engages the movable member 126 and effects movement thereof toward and away from the stop 120.

Figure 5:
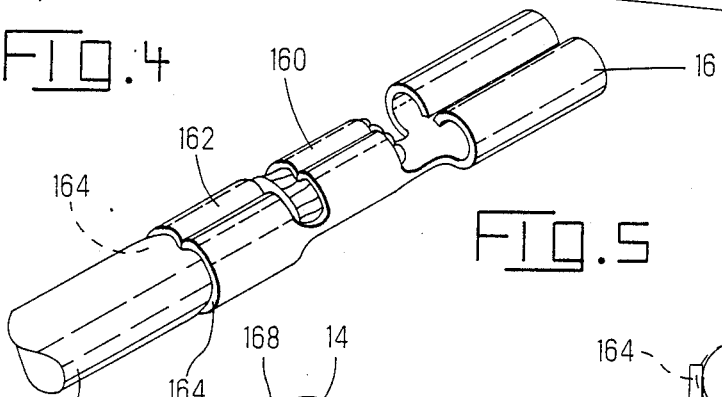
FIG. 5 is an isometric view of a wire having a contact crimped thereto.
Figure 6:
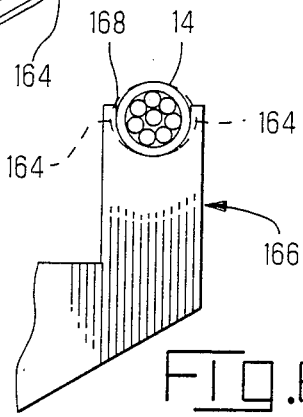
FIG. 6 is a front view of a portion of the wire stop.

There is shown in FIG. 5, a wire 14' having a contact 16 terminated thereto. Note that the contact includes two crimped portions, a portion 160 which is crimped to the conductor of the wire, and a portion 162 which is crimped to the insulation of the wire. By the nature of the crimping process, the portion 162 includes bulges 164 of the contact metal which exceed the diameter of the wire insulation as shown. There is shown in FIG. 6 a portion of an end 166 of the stop 120 having a U-shaped opening 168 formed therein and sized to closely receive the wire 14. It should be understood that when a wire 14' having a contact 16 terminated thereto, as shown in FIG. 5, is placed within the U-shaped opening 168, as shown in FIG. 6, the bulges 164 of the contact will not permit entry of the contact 16 into the U-shaped opening 168. That is, if the terminated wire 14' were moved axially in a direction to bring the contact 16 toward the stop 120, the bulges 164 would abut the stop and prevent further axial movement. This feature has a very important advantage as will be set forth below.

Figure 4:
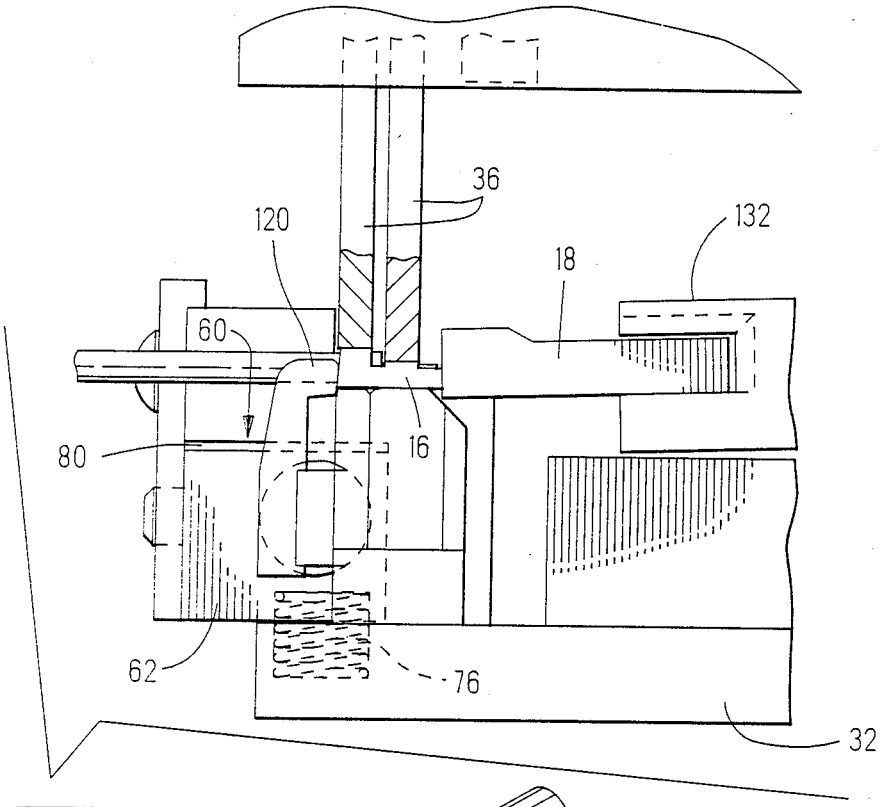
FIG. 4 is a view of a portion of the view shown in FIG. 2 showing the contact being crimped onto the wire.
Figure 10:
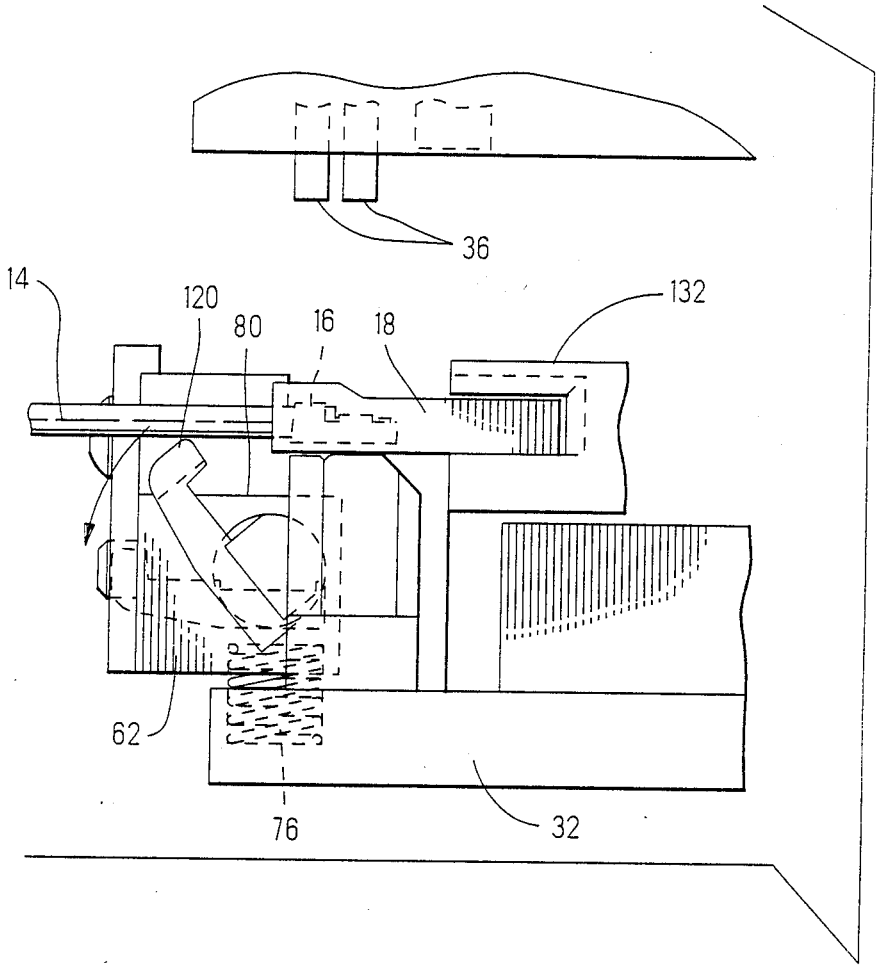

In operation the feed mechanism 24 is initialized as is shown in FIG. 1 where a first terminal 12' is positioned with the contact 16 in crimping position in alignment with the anvil 40 and the crimp tooling 36. A wire 14 is positioned within the workstation 26 as shown in FIGS. 1 and 2. This may be done manually or by another machine such as a lead making machine. The wire 14 must be permitted to flex downwardly to the surface of the anvil 40 during the crimping process as will be described. With the wire 14 in position as shown in FIGS. 1 and 2, the ram 34 is caused to move downwardly, the crimp tooling 36 straddling and carrying the wire 14 downwardly and into engagement with the open tangs of the contact 16. Further downward movement of the ram 34 causes the wire 14 to press into the U-shaped opening 168 thereby pushing the stop 120 a slight amount downward, compressing the spring 76, until the contact 16 is fully seated against the anvil 40, as is best seen in FIG. 4. Note that the bar 62 has pivoted downwardly a slight amount as indicated by the gap shown at 80 in FIG. 4. Note also that as the contact 16 was moved from its position spaced from the anvil 40, as shown in FIG. 2, to its position in engagement with the anvil, as shown in FIG. 4, the housing 18 and pusher 132 were required to pivot a slight amount counterclockwise about the pivot pin 134. This pivoting of the pusher 132 compresses the spring 144 a corresponding amount. After the crimp portions 160 and 162 are formed and the housing 18 is severed from the carrier strip 20, the ram 34 and crimp tooling 36 withdraw as shown in FIG. 8. This permits the stop 120 and wire 14 to move upwardly under the urging of the spring 76 until the bar 62 moves upwardly, closing the gap at 80 as shown in FIG. 8. Concurrently, the housing 18 and pusher 132 pivot clockwise about the pivot pin 134 under the urging of the spring 144 until the set screw 142 engages the surface 150 of the nest 130. The contact 16 is thereby spaced from the anvil 40 by an amount which will permit assembly of the insulating housing 18. The cylinder 156 is then activated causing the movable member 126 of the slide 122 to move the pusher 132 toward the stop 120, thereby sliding the insulated housing 18 over the contact 16 and into assembled engagement therewith as shown in FIG. 9. As the pusher 132 is moving toward the stop 120, the contact 16 is urged in the same direction until the bulges 164 engage the stop 120 thereby preventing further movement of the contact 16 in that direction. The contact 16 is sufficiently spaced from the anvil 40 to permit the housing 18 to pass over the anvil 40 and a portion of the stop 120 to enter the interior of the insulated housing 18 an amount sufficient to allow full assembled engagement of the terminal 12. As the ram 34 continues to withdraw, the air cylinder 156 is caused to reverse direction and move the pusher 132 away from the stop 120, the air cylinder 102 is actuated to pivot the stop 120 away from and out of alignment with the anvil 40 as shown in FIG. 10, and then the feed mechanism 24 advances the carrier strip 20 and associated terminals 12 to the right, as viewed in FIG. 1, until the terminal 12' is pushed completely through the channel 152 and the next terminal 12 is in crimping position in the workstation 26 and the stop 120 is pivoted so that the U-shaped opening is adjacent and in alignment with the anvil as shown in FIGS. 1 and 2. The above process may then be repeated any desired number of times.

Figure 7:
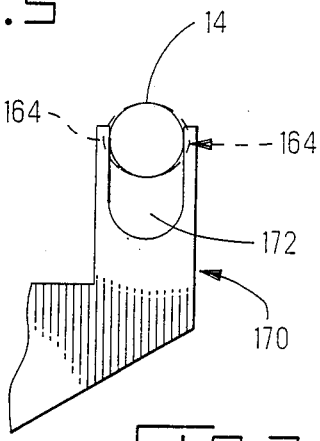
FIG. 7 is a partial front view of a second embodiment of the wire stop.

A second embodiment of the invention is illustrated in FIG. 7 which shows a portion of an end 170 of the stop 120, similar to the end 166 shown in FIG. 6, except that it includes a U-shaped opening 172 that is deeper than the opening 168. The depth of the opening 172 is chosen so that the wire 14 may freely move downwardly without engaging the bottom of the opening during downward movement of the crimp tooling 36 during the crimping operation as described above. In such case the bar 71 need not have the capability of pivoting about the pins 66 as in the first embodiment and would allow for a somewhat simpler structure. However, in this case the pivotal motion of the pusher 132 under the urging of the spring 144 must be sufficient to lift the contact 16 and attached wire 14 sufficiently high above the anvil 40 to permit assembly of the housing 18 to the contact as described above.

An important advantage of the present invention is that the substantial force, about seven pounds, required to slide the insulated housing over the contact and into assembled engagement is limited to the bulges 164 of the contact in abutting engagement with stop 120. This completely obviates the need for tightly clamping the wire and the resulting damage to the insulation as with prior art machines. Another important advantage is that both the crimping operation and assembly operation are performed in one machine cycle of the ram.

We claim:

1. A method of assembling an electrical terminal in a workstation having a stop, said terminal including a contact and a housing, comprising the steps:

(a) positioning said contact and housing in said workstation, ar end of said contact being adjacent said stop;

(b) positioning a wire to be terminated to said contact in said workstation;

(c) terminating said contact to said wire; and (d) moving said housing in a direction toward said stop so that said end of said contact abuts said stop and said housing moves into assembled engagement with said contact.

2. A method according to claim 1 including after step (d):

(e) moving said stop from its position in step (a), in a direction away from said end of said contact;

(f) removing the terminated wire and terminal; and (g) moving said stop back to its position in step (a).

3. A method according to claim 2 wherein said moving said stop of steps (e) and (g) include pivoting said stop about an axis which is spaced from said terminal and positioned substantially normal to a longitudinal axis of said wire and terminal.

4. The method according to claim 1 wherein said work station includes an anvil and a crimping tool and said terminating of step (c) includes moving said crimping tool so that said contact is brought into engagement with said anvil, and after step (c) and prior to step (d) including the step:

(C1) moving said contact away from said anvil a predetermined distance, whereby said housing can be assembled to said contact without engaging said anvil.

5. The method according to claim 4 wherein said moving said contact in step (C1) is effected by urging said wire and said housing upwardly away from said anvil.

6. The method according to claim 1 wherein said moving of step (d) includes moving said housing so that said end of said contact abuts said stop in two places on substantially opposite sides of said wire.

7. An apparatus for assembling an electrical terminal having a contact and a housing, comprising;

(a) a workstation;

(b) stop means in said workstation;

(c) means for positioning said electrical terminal within said workstation so that an end of said contact is adjacent said stop means;

(d) means for terminating said contact to said wire; and (e) means for moving said housing in a direction toward said stop means so that said end of said contact abuts said stop means and said housing moves into assembled engagement with said contact.

8. The apparatus according to claim 7 wherein said stop means includes a stop member having a U-shaped opening sized to receive said wire while excluding said contact which is crimped to said wire so that as said wire is moved axially within said U-shaped opening in a direction to bring said contact toward said stop member, said contact will abut said stop member and prevent further axial movement.

9. The apparatus according to claim 8 including a frame and a base rigidly attached to said frame, a ram arranged for reciprocating motion within said frame in a direction toward said base and in an opposite direction and wherein said means for terminating includes a crimp tool attached to and carried by said ram and an anvil attached to said base in alignment with said crimp tool, said stop member being adjacent said anvil and wherein said means for positioning said terminal is arranged to position said contact of said terminal in alignment with said anvil and said crimp tool and adjacent said U-shaped opening of said stop member.

10. The apparatus according to claim 9 wherein said means for moving said housing includes a slide having a stationary portion attached to said base and a movable portion arranged to undergo movement toward and away from said anvil from a position opposite said stop member, said movable portion including a pusher attached thereto having a cavity for receiving said housing, said movable portion being operationally coupled to a linear actuator for effecting said movement thereof so that when said contact of said terminal is in alignment with said anvil and said crimp tool, said housing of said terminal is within said cavity, and actuation of said linear actuator will cause said housing to move toward said stop member and into assembled engagement with said contact.

11. The apparatus according to claim 9 wherein said stop member is arranged to undergo movement in a direction toward said base and in an opposite direction, said movement being substantially parallel to said reciprocating movement of said ram, and wherein said stop means includes resilient means for urging said stop member in said opposite direction.

12. The apparatus according to claim 11 wherein said stop means includes means for pivoting said stop member in one direction so that said U-shaped opening is adjacent to and in alignment with said anvil and in an opposite direction so that said U-shaped opening is spaced from and out of alignment with said anvil, both of said pivoting movements occurring during a simple reciprocating cycle of said ram.

13. The apparatus according to claim 10 wherein said pusher is pivotally attached to said movable portion of said slide at an end opposite said cavity so that said cavity will undergo movement in a direction toward said base and in an opposite direction, said movement being substantially parallel to said reciprocating movement of said ram, and including resilient means for urging said cavity in said opposite direction.

14. The apparatus according to claim 13 including adjusting means for adjustably limiting said movement of said cavity in said opposite direction.

* * * * *